US006817397B2

(12) United States Patent
Bixen

(10) Patent No.: US 6,817,397 B2
(45) Date of Patent: Nov. 16, 2004

(54) SPRING MOUNT FOR LABEL APPLICATOR TAMP PAD

(75) Inventor: Robert W. Bixen, Dorsey, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 147 days.

(21) Appl. No.: 10/350,720

(22) Filed: Jan. 24, 2003

(65) Prior Publication Data

US 2004/0144497 A1 Jul. 29, 2004

(51) Int. Cl.[7] ..... B65C 9/26; B65C 9/36

(52) U.S. Cl. ..... 156/556; 156/566; 156/571; 156/572; 156/DIG. 37; 156/DIG. 42

(58) Field of Search ..... 156/391, 538–542, 156/556, 566, 569–572, 580, DIG. 8, DIG. 24, DIG. 28, DIG. 30, DIG. 37, DIG. 42

(56) References Cited

U.S. PATENT DOCUMENTS

| | | | |
|---|---|---|---|
| 4,595,447 | A | 6/1986 | Lindstrom |
| 4,844,771 | A | 7/1989 | Crankshaw et al. |
| 5,232,539 | A | 8/1993 | Carpenter et al. |
| 5,236,535 | A | 8/1993 | Smith |
| 5,300,181 | A | 4/1994 | Yamaguchi |
| 5,435,862 | A | 7/1995 | Williams et al. |
| 5,472,552 | A | 12/1995 | Speranza et al. |
| 5,753,072 | A | 5/1998 | Taylor |
| 6,006,808 | A | 12/1999 | Ewert et al. |

*Primary Examiner*—Sue A. Purvis
(74) *Attorney, Agent, or Firm*—Mark W. Croll, Esq.; Donald J. Breh, Esq.; Welsh & Katz, Ltd.

(57) ABSTRACT

A swivel mount is configured for use with a tamp pad for a label applicator of the type for receiving a label at a first retracted position and applying the label to an object at a second, extended position. The mount includes a mounting block for fastening to the tamp pad. The mounting block has a bore therein having an inner, open cross-sectional region and a retaining region. A knuckle fitting is received within the bore and is engageable with the retaining region. The knuckle fitting has a largest cross-sectional area that is larger than the open cross-sectional area of the retaining region such that a portion of the knuckle fitting is retained within the bore. A spring is positioned to provide a force against the knuckle fitting against the retaining region. The mount permits movement of the tamp pad from an orientation perpendicular to a direction of movement between the retracted and extended positions to an orientation inclined relative to the direction of movement.

21 Claims, 2 Drawing Sheets

SPRING MOUNT FOR LABEL APPLICATOR TAMP PAD

BACKGROUND OF THE INVENTION

The present invention relates to a label applicator. More particularly, the present invention pertains to a spring mount for a label applicator tamp pad.

Automated label applicators or label machines are well known in the art. A typical machine feeds a continuous web of label material (which web material includes a carrier or liner and a series of discrete labels adhered to the liner at intervals along the liner), removes the labels from the liner and applies the labels to the objects. In many such machines, the label is also printed by the device, prior to separation from the liner and application to the objects.

Known label machines include, generally, a supply roll on which the web is wound. The web is fed from the supply roll around a plurality of rollers and enters a printing head. In the printing head, indicia are printed on to the individual labels. The web exits the print head and the labels are separated from the liner and are urged into contact with a tamp pad.

The tamp pad is, typically, a vacuum assisted assembly that holds the individual labels and moves the labels into contact with the objects onto which they are adhered. Tamp pads are typically designed to apply a predetermined or desired force upon application of the label to the object. The force used to apply the label can be varied depending upon the object. For example, while a relatively larger force can be used to apply a label to a heavy gauge shipping carton, a much lesser force must be used when applying a label to, for example, a bakery carton.

In operation, the label is separated from the liner and is held on the tamp pad. The label remains on the pad until the target object is in line with the pad. A tamp cylinder then extends to move the tamp pad into contact with the object surface to apply the label to the surface. At the completion of the extension stroke, the cylinder returns the pad to the home or rest position at which time a subsequent label can be fed onto the tamp pad. In many known arrangements, the tamp pad is rigidly mounted to the extendable cylinder rod.

Tamp pads are configured such that a label is transferred onto the pad after it is separated from the liner with the non-adhesive side of the label contacting an impact plate (on the front side of the pad). The label is held on the plate and the tamp pad is extended toward the product surface for application of the label. In a typical arrangement, a vacuum is used to secure the label to the impact plate. Typical impact pads are formed from a low friction material having a plurality of vacuum openings formed therein. Vacuum channels formed in the rear of the plate permit the transfer of vacuum to the front surface of the impact plate to secure the label to the plate.

In that it is desirable to transfer the label and apply the label to the product surface at a relatively high rate of speed, the transfer process inherently controls the throughput of the label machine. However, the objects to which the labels are applied may not necessarily be properly oriented on the object line path. That is, the cartons may not all lie straight on the machine line such that the plane of the panel onto which the label is applied is perpendicular to the direction of extension of the cylinder. As such, labels can be misapplied or less than fully applied to the carton panel.

One known arrangement to accommodate a slightly askew carton includes a tamp pad that is mounted to a mounting plate by a plurality of corner mounted springs and shoulder bolts. While such an arrangement serves to accommodate carton skew to a point, it requires a complex arrangement of bolts and springs, as well as a complex arrangement for the traverse of vacuum tubes and the like to provide the necessary structural vacuum connections to the tamp head. Moreover, with this type of mount, as the angle at which the pad contacts the carton increases, the pad "rotates" away from a plane perpendicular to the direction of extension of the cylinder.

When the angle increases too greatly, the edges of the pad around the bolt openings can bind on the bolts. In such an event, the pad can become "stuck" on the bolts at an angle. This, of course, would require that machine operation be halted so that the pad can be readjusted to the desired, perpendicular orientation. Given that the label applying operation is a relatively high speed operation, this could have a substantial adverse impact to machine and/or line operations.

Accordingly, there exists a need for a tamp pad mount that accommodates the skew of a carton panel or other object onto which the label is applied. Desirably, such a mount is biased to a perpendicular orientation, and is readily moved from the perpendicular position to properly apply the label to the panel. More desirably, such a mount is simple in design, prevents binding at an undesirable angle, and can be fitted onto existing label applicator machines.

BRIEF SUMMARY OF THE INVENTION

A swivel mount is configured for mounting a tamp pad to a label applicator of the type for receiving a label at a first retracted position and applying the label to an object at a second, extended position. The mount permits the application of a label to an object, such as a carton panel and accommodates the skew of the carton panel or other object. Such a mount is biased to a perpendicular orientation, and is readily moved from the perpendicular position to properly apply the label to the panel.

The mount includes a mounting block for fastening to the tamp pad. The mounting block has a bore therein having an inner, open cross-sectional region and defines a retaining region therein. In a current embodiment, the retaining region is configured as a collar.

A knuckle fitting is received within the bore and engages or seats in the retaining region. The knuckle fitting has an increasing cross-sectional area that is, at its largest point, larger than the open cross-sectional area of the retaining region. In this manner only a portion of the knuckle fitting extends beyond the collar, while another portion of the knuckle fitting is maintained within the bore.

In a present embodiment, the knuckle has tapered side walls and the collar has mating side walls. A present taper angle is about 20 degrees. In this arrangement, the knuckle fitting has a frusto-pyramidal shape, and preferably a square frusto-pyramidal shape. The corners defined by the frusto-square pyramidal shape can be rounded.

A spring is positioned to provide a force against the knuckle fitting at an end of the second portion. The spring seats the knuckle fitting within the collar. Preferably, the spring is centrally disposed relative to a longitudinal axis or plane through the mount.

To maintain the spring and knuckle fitting within the mounting block, a cover can be positioned on the mounting block extending over the bore and the spring. The cover further assures that the spring force acts on the knuckle fitting maintaining the fitting centered within the block.

A present knuckle fitting is formed from an aluminum alloy, such as alloy 7075-T6 with a hardcoat anodized finish. Such a material provides the strength, durability and wear resistance needed for such a part in a high cycle environment.

The present mount permits movement of the tamp pad from an orientation perpendicular to a direction of movement between the retracted and extended positions to an orientation inclined relative to the direction of movement. Moreover, it permits such movements, and facilitates return to the perpendicular orientation, in a relatively light weight and efficient, yet simple design. Further, the present mount has been found to overcome many of the problems of known designs, other than complexity, such as pad binding and sticking.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
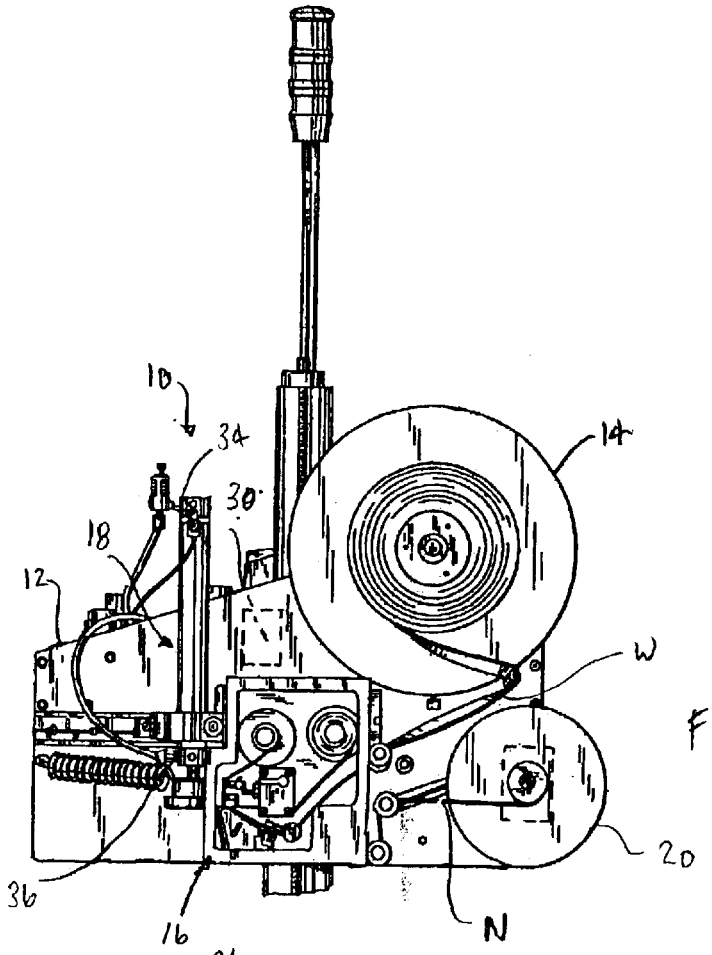
FIG. 1 is a front view of an exemplary label printer applicator having a spring mounted tamp pad embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular, to FIG. 1 there is shown generally an exemplary automatic label printer applicator 10 or label machine 10. The machine 10 includes a frame or stand 12 and is positioned above objects (not shown) onto which labels are placed. The frame 12 has mounted thereto a supply or unwind roll 14, a print head 16, a tamp pad assembly 18 and a take-up or rewind roll 20. The exemplary label printer applicator 10 is commercially available from ITW Diagraph of St. Charles, Mo. as product model ALP/4500. Such a machine 10 is more fully disclosed in copending to Dods U.S. Ser. No. 10/213,654, filed Aug. 6, 2002, and entitled "Label Printer Applicator Unwind Sensor", which patent application is commonly assigned with the present application and is incorporated herein by reference.

A web, indicated generally at W (which includes a backing or liner strip N on which discrete labels are adhered), is fed from the supply roll 14 and traverses through the print head 16, in which indicia are printed on the individual labels. The labels are then separated from the web W by a separating blade 22 and are transferred to a tamp pad 24 on the tamp pad assembly 18. A tamp pad cylinder 26 includes a reciprocating cylinder rod 28 (having the tamp pad 24 mounted thereto) that extends to apply the label to the surface of the object. The liner N, after the labels have been removed, is then wound onto the take-up or rewind roll 20. The operation of the label machine 10 is controlled by a controller 30 mounted local to (or on) the machine 10.

Figure 2:
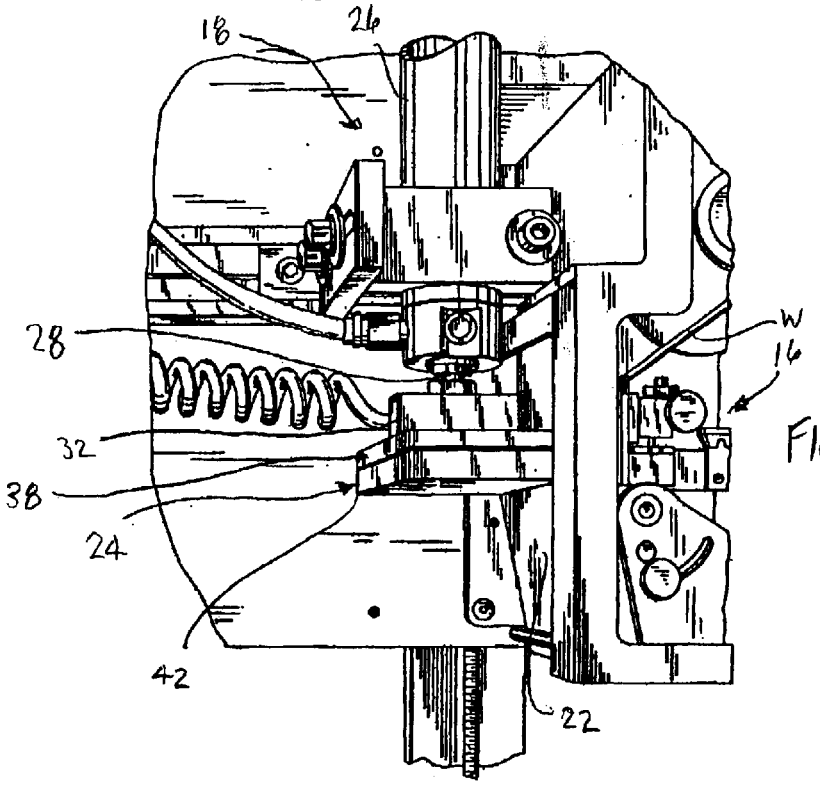
FIG. 2 is an enlarged, partial front view of the applicator showing the present spring mount as used in mounting a tamp pad to the applicator.
Figure 3:
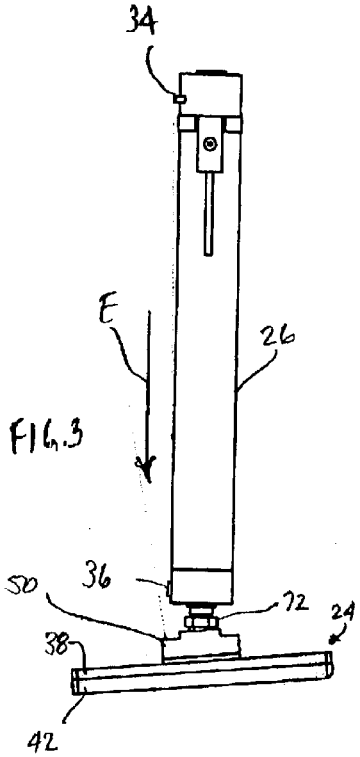
FIG. 3 is a schematic illustration of the tamp pad cylinder and mount showing the tamp pad slightly skewed for applying a label to a non-perpendicular panel.
Figure 4:
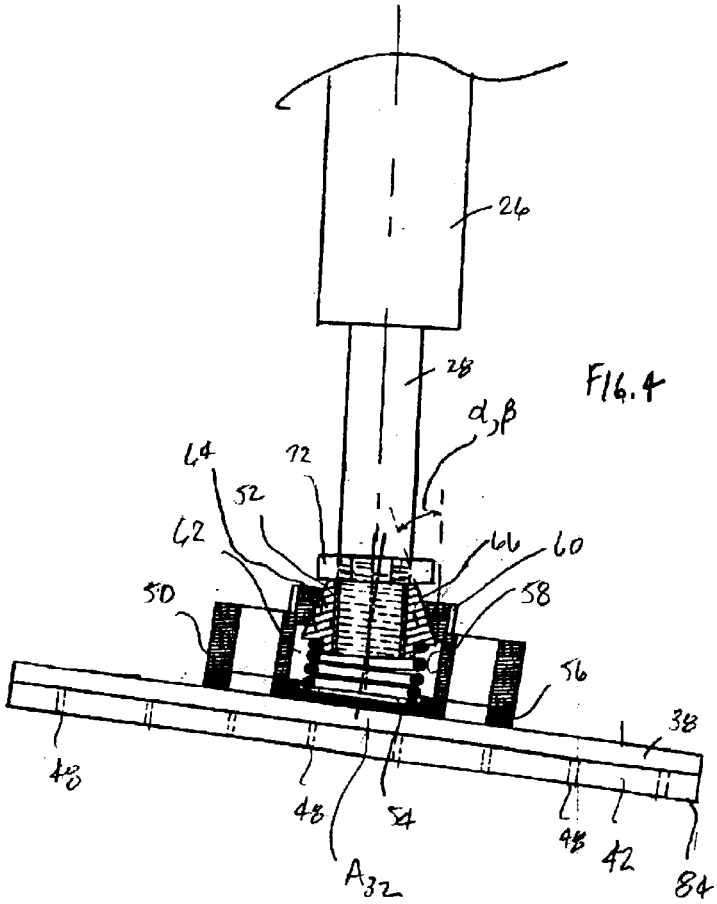
FIG. 4 is a partial cross-sectional view of the tamp pad cylinder and mount arrangement, the tamp pad again being shown slightly askew as it would apply a label to a non-perpendicular panel.

Referring now to FIGS. 2–4, the tamp pad 24 is part of the overall tamp pad assembly 18. In a present embodiment, the cylinder 26 is a pneumatic cylinder. The tamp pad 24 is mounted to the cylinder rod 28 by a spring mount 32 and moves with extension and retraction of the cylinder rod 28 between the label applying or extended position and a label receiving or home position. These positions are the positions at which the label is applied to the product surface and the position at which the label is moved onto the tamp pad after separation from the liner N.

In a present arrangement, a dual action cylinder 26 is used. That is, compressed air (or a like compressed gas) is applied to one side of a piston in the cylinder 26 to extend the cylinder rod 28 and is applied to an opposing side of the piston to retract the rod 28. Compressed air supply lines extend from a compressed air source (not shown) to inlets 34, 36 at opposing sides of the cylinder 26 to move the rod 28 between the extended and home positions.

A present tamp pad 24 is configured to allow changing label sizes quickly and to allow use of a single pad with multiple size labels. This flexible design is more fully disclosed in the aforementioned U.S. patent application Ser. No. 10/213,654. The tamp pad 24 includes a rear mounting plate 38 onto which a vacuum inlet, such as the illustrated vacuum elbow fitting 40 is mounted.

An impact plate 42 is mounted to the rear mounting plate 38. The impact plate 42 is that plate onto which the label is transferred and is carried to the object surface for adhering to the object. The impact plate 42 is mounted to the rear mounting plate 38 by a plurality of fasteners, such as the illustrated flat head machine screws 44. The vacuum fitting 40 in the mounting plate 38 provides communication of vacuum from the vacuum source to channels 46 in the rear side of the impact plate 42. The impact plate 42 has through-plate openings 48 from the channels 46 that open into the front surface of the plate 42 for securing the label to the plate 42.

The tamp pad 24 is mounted to the cylinder rod 28 by the spring mount 32. The spring mount 32 is rigidly fastened to the rear mounting plate 38. The mount 32 provides a simple, biased movable connection of the tamp pad 24 to the cylinder rod 28. Referring to FIGS. 3 and 4, a present spring mount 32 includes a mounting block 50, a knuckle connector fitting 52, a biasing element 54, such as the illustrated coil spring, and a block cover 56. The mounting block 50 has a cavity 58 formed therein for receiving the knuckle fitting 52. A collar 60 extends upwardly from the block 50 about the cavity 58. A bore 62, which is contiguous with the cavity 58, extends from the cavity 58 through the collar 60.

Figure 5:
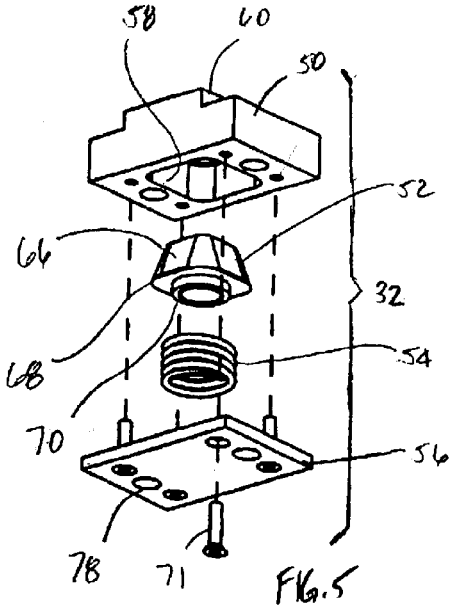
FIG. 5 is an exploded view of the spring mount.
Figure 6:
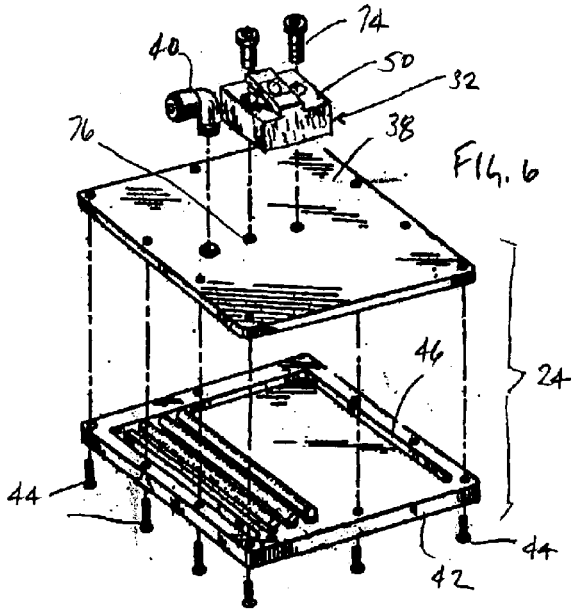
FIG. 6 is an exploded view of an exemplary tamp pad showing the impact plate and the rear mounting plate, and the mounting of the mounting block thereto.

The interior surfaces, indicated generally at 64, that define the collar 60, at the bore 62, are formed as upwardly, inwardly tapered surfaces and the knuckle fitting 52 has mating tapered outer surfaces, indicated generally at 66, to maintain the fitting 52 centered when it is seated within the bore 62 at the collar 60. In a present embodiment, the cavity 58, bore 60, collar 62 and knuckle fitting 52 all have a generally square cross-sectional profile to further provide mating surfaces and centering of the knuckle fitting 52 within the mounting block 50 and bore 62. As best seen in FIGS. 4 and 5, the knuckle fitting 52 has a generally obelisk-like (frusto-square pyramidal) shape, having rounded corners 68. The collar mating surfaces 64 define a like obelisk-like (frusto-square pyramidal) shape.

A lip 70 extends downwardly from the knuckle fitting 52 (about the bore 62), and the spring 54 is positioned about the lip 70 to retain the spring 54 in place. Preferably, the spring 54 is centrally disposed in the bore 60 relative to a longitudinal axis $A_{32}$ through the mount 32. The cover 56 is fastened to the mounting block 50 by fasteners 71 to secure the spring 54 about the knuckle fitting lip 70 and to secure the knuckle fitting 52 within the block 50. In this manner, the spring mount 32 is a fully contained, readily installed one-piece fitting.

The terms upwardly and downwardly are used in reference to the direction in which various components and surfaces extend for purposes of description only. Those skilled in the art will appreciate from a study of the present description and figures that the present applicator 10 is a vertically operating applicator 10. That is, the tamp pad 24 and cylinder 26 operate in a vertical, up-and-down movement to apply labels to objects. The present mount 32 can, however, be effectively used in horizontally or other oriented applicators in which the tamp pad, cylinder and associated components would operate in a horizontal plane. Such a horizontal orientation is within the scope and spirit of the present invention.

Referring to FIG. 3, to attach the spring mount 32 to the cylinder rod 28, the end of the rod 28 has an externally threaded surface and the interior of the knuckle fitting 52 has a mating internal thread. Thus, to attach the fitting 52 (as captured within the mounting block 50) to the rod 28, the fitting 52 is merely threaded onto the rod 28. To secure the knuckle fitting 52 in place on the rod 28, i.e., to prevent the knuckle 52 from loosening or tightening by rotating about the threads, a jam nut 72 can be turned and tightened down onto the knuckle fitting 52 at the knuckle fitting 52-rod 28 interface. Alternately, as will be recognized by those skilled in the art, various other methods and devices can be used to secure the knuckle fitting 52 in place on the rod 28, such as thread locking tape, pins and the like, which other methods and devices are within the scope and spirit of the present invention.

The mounting block 50 is fastened to the tamp pad rear mounting plate 38 by a plurality of fasteners 74 that insert through the mounting block 50 and thread into mounting openings 76 in the plate 38. The cover 56 has aligned holes 78 to permit passing the fasteners 74 through the cover 56 and into the plate 38.

As will be appreciated by those skilled in the art from a study of the figures and above description, the present spring mount 32 accommodates the application of labels onto skewed surfaces. When operating, the tamp pad 24 is oriented perpendicular to the direction of extension E of the cylinder rod 28. In the event that a panel (onto which the label is applied) is skewed, an edge or corner 84 of the tamp pad 24 will contact the panel and the tamp pad 24 will move, e.g., swivel, to orient the pad 24 parallel to the surface to properly apply the label. The spring 54 urging the knuckle tapered surfaces 66 against the collar inner tapered surfaces 64 permits the pad 24 to swivel and, advantageously returns the tamp pad 24 to the perpendicular orientation once the pad 24 moves out of contact with the surface.

In a current embodiment, the taper angle $\alpha$ of the knuckle fitting surfaces 66 is about 20 degrees. The taper angle $\beta$ of the collar inner surfaces 64 is likewise about 20 degrees. These matching taper angles $\alpha$ and $\beta$ have been shown to function quite well to permit the pad 24 to swivel to essentially any position to accommodate carton skew, while at the same time to return the tamp pad 24 to the perpendicular orientation after carton contact. As will be appreciated to those skilled in the art, the present design overcomes the binding problem associated with known corner bolt mounting arrangements in that there is no bolt on which to bind or hang up the mount.

It will also be appreciated that the present spring mount 32 configuration permits the tamp pad 24 to torque about the axis that defines the direction of extension E (which is also coincident with the mount axis $A_{32}$), and return back to a home position for receiving a subsequent label. That is, the knuckle fitting 52 will allow the pad 24 to move slightly in a plane perpendicular to the axis $A_{32}$ and will return the pad to the home position by engagement of the knuckle fitting surfaces 66 with the collar surfaces 64 that urge the knuckle 52 to squarely "seat" within the collar 62.

In the current embodiment, it has been found that the material selection for the knuckle fitting 52, while not critical, must take into consideration the magnitude and intensity of cycling to which the mount 32 is expected to be subjected. That is, because of the high operating line speeds and the variations in the angle of carton panels, the mount 32 must be sufficiently strong to overcome rigorous operating conditions. It has been found that an aluminum alloy, specifically, Alloy 7075-T6, commercially available from the TENNALUM® division of Kaiser Aluminum, of Jackson, Tenn., is suitable for use for manufacture of the knuckle fitting 52 of the present mount 32. It has also been found to be advantageous to use a hardcoat anodizing on the knuckle fitting 52 to improve wear resistance and to increase life, as well as to facilitate movement of the fitting 52 within the mounting block 50 during operating conditions.

Other materials are also contemplated for use in the present spring mount 32. For example, metals such as hardened steel and various plastic materials, such as a self-lubricating plastic, may also be suitable for use in the present mount 32, which other materials are within the scope and spirit of the present invention.

The simple design of the present spring mount 32 permits retrofitting existing label applicators to accommodate the mount 32. In that a minimal number of parts have been added to known tamp pad mounting arrangements, the added weight, if any, of the present mount 32 will have minimal, if any, adverse impact on overall applicator machine 10 operations.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the invention.

What is claimed is:

1. A swivel mount for a tamp pad for a label applicator of the type for receiving a label at a first retracted position and applying the label to an object at a second, extended position, the mount comprising:

a mounting block for fastening to the tamp pad, the mounting block defining a bore therein having an inner, open cross-sectional region, the mounting block defining a retaining region therein;

a knuckle fitting received within the bore and engageable with the retaining region, the knuckle fitting having a largest cross-sectional area greater than an open cross-sectional area of the retaining region such that a first portion of the knuckle fitting extends beyond the retaining region and a second portion of the knuckle fitting is maintained within the bore; and a spring positioned to provide a force against the knuckle fitting at an end of the second portion;

wherein the mount permits movement of the tamp pad from an orientation perpendicular to a direction of movement between the retracted and extended positions to an orientation inclined relative to the direction of movement.

2. The swivel mount in accordance with claim 1 wherein the retaining region is defined by a collar and wherein the knuckle fitting first portion fits within the collar.

3. The swivel mount in accordance with claim 2 wherein the knuckle has tapered side walls and wherein the collar has mating tapered side walls.

4. The swivel mount in accordance with claim 3 wherein an angle of taper of the knuckle side walls and the collar side walls is about 20 degrees.

5. The swivel mount in accordance with claim 1 including a cover positioned on the mounting block and extending over the bore and the spring to maintain the spring and knuckle fitting within the mounting block.

6. The swivel mount in accordance with claim 1 wherein the knuckle fitting has a frusto-pyramidal shape.

7. The swivel mount in accordance with claim 6 wherein the frusto-pyramidal shape is a square pyramid.

8. The swivel mount in accordance with claim 7 wherein corners defined by the frusto-square pyramidal shape are rounded.

9. The swivel mount in accordance with claim 1 wherein the knuckle fitting is formed from an aluminum alloy.

10. The swivel mount in accordance with claim 9 wherein the aluminum alloy is alloy 7075-T6.

11. The swivel mount in accordance with claim 1 wherein the spring is centrally positioned within the mount relative to a longitudinal axis extending though the mount.

12. A swivel mount for a tamp pad for a label applicator of the type for receiving a label at a first retracted position and applying the label to an object at a second, extended position, the mount comprising:

a mounting block for fastening to the tamp pad, the mounting block defining a bore therein and having a collar extending from about the bore, the collar defining an inner, open square cross-sectional region having inwardly tapered walls defining a frusto-pyramidal shape;

a knuckle fitting received within the bore and engageable with the collar, the knuckle fitting having a frusto-pyramidal shape for mating with the collar, a base of the knuckle fitting having a greater cross-sectional area than a smallest cross-sectional area of the collar open cross-sectional area such that a portion of the knuckle fitting extends into and is retained by the collar;

a spring positioned to provide a force against the knuckle fitting; and a retaining member extending over the bore and spring to maintain the spring and knuckle fitting within the mounting block, wherein the mount permits swivel movement of the tamp pad from an orientation perpendicular to a direction of movement between the retracted and extended positions to an orientation inclined relative to the direction of movement.

13. The swivel mount in accordance with claim 12 wherein the frusto-pyramidal knuckle fitting and collar walls are formed at an angle of about 20 degrees.

14. The swivel mount in accordance with claim 12 wherein the knuckle fitting has a bore formed therein having a thread formed on at least a portion thereof.

15. The swivel mount in accordance with claim 12 wherein the frusto-pyramidal knuckle fitting and collar walls are formed as square pyramids.

16. The swivel mount in accordance with claim 12 wherein the spring is centrally disposed within the mount.

17. A swivel mount for a tamp pad for a label applicator of the type for receiving a label at a first retracted position and applying the label to an object at a second, extended position, the mount comprising:

a mounting block for fastening to the tamp pad, the mounting block defining a bore therein having an inner, open cross-sectional region and an open tapering collar region having a smaller open cross-sectional region than the bore open cross-sectional region;

a knuckle fitting received within the bore and engageable with the open tapering collar, the knuckle being retained within the mounting block such that a portion of the knuckle fitting is retained within the bore; and a spring positioned to provide a force against the knuckle fitting to retain the knuckle fitting seated within the mounting block and to permit swivel movement of the knuckle fitting relative to the mounting block.

18. The swivel mount in accordance with claim 17 including a cover extending over the mounting block opposite of the collar for retaining the knuckle fitting and spring within the bore.

19. The swivel mount in accordance with claim 17 wherein the mounting block and knuckle fitting have mating inner non-parallel surfaces for centering the knuckle fitting within the bore and collar.

20. The swivel mount in accordance with claim 19 wherein the non-parallel surfaces are formed at an angle of about 20 degrees relative to a plane extending longitudinally through the mount.

21. The swivel mount in accordance with claim 17 wherein the spring is centrally disposed within the mount.

* * * * *